US006598591B2

(12) United States Patent
Lewis

(10) Patent No.: US 6,598,591 B2
(45) Date of Patent: Jul. 29, 2003

(54) MEASURING CHECK MOTION THROUGH PRESSURE SENSING

(75) Inventor: Stephen R. Lewis, Minonk, IL (US)

(73) Assignee: Caterpillar Inc, Peoria, IL (US)

( * ) Notice: Subject to any disclaimer, the term of this patent is extended or adjusted under 35 U.S.C. 154(b) by 35 days.

(21) Appl. No.: 10/023,577

(22) Filed: Dec. 18, 2001

(65) Prior Publication Data

US 2003/0111049 A1 Jun. 19, 2003

(51) Int. Cl.[7] ..... F02M 37/04
(52) U.S. Cl. ..... 123/467; 123/494
(58) Field of Search ..... 123/467, 494; 239/96

(56) References Cited

U.S. PATENT DOCUMENTS 4,438,496 A * 3/1984 Ohie ..... 123/478
5,671,715 A * 9/1997 Tsuzuki ..... 123/467
5,722,373 A * 3/1998 Paul et al. ..... 123/446
6,213,093 B1 * 4/2001 Yudanov et al. ..... 123/446
6,253,736 B1 7/2001 Crofts et al.
6,318,342 B1 * 11/2001 Simon et al. ..... 123/494

* cited by examiner

*Primary Examiner*—Thomas N. Moulis
(74) *Attorney, Agent, or Firm*—Mike Huber

(57) ABSTRACT

A valve using a pressure control cavity to control valve position can implement a pressure to sensor to determine the pressure within the control cavity to determine whether pressure is presently acting upon the valve. The pressure sensor can provide a feedback signal to a control module allowing the control module to control timing of the valve.

18 Claims, 2 Drawing Sheets

MEASURING CHECK MOTION THROUGH PRESSURE SENSING

TECHNICAL FIELD

The present invention relates to fuel injectors and specifically to an apparatus and method of determining check motion through pressure sensing.

BACKGROUND

As emissions continue to drive engine development, exact control of the fuel injector becomes vital. By controlling how and when fuel is injected, combustion is enhanced and emissions are reduced. Fuel injectors have improved substantially over the years, particularly with the development of the direct controlled check but more control is still necessary. For example, although, the check is now directly controlled, it would be beneficial to have feedback regarding the exact movement of the check.

In U.S. Pat. No. 6,253,736 B1, issued to Crofts et al., a check feedback system is illustrated. Specifically, the '736 patent requires the use of a piezo actuator in direct contact with a control valve that controls pressure on top of the needle valve. The control valve must be positioned in close proximity to the needle valve so that at the maximum open position the control valve contacts the needle valve which then creates a axial force that is transmitted back to the piezo actuator. The axial force compresses some of the piezo elements, generating a voltage and causing a spike in the voltage curve. By monitoring the voltage curve, the control system can then determine when the needle valve is at a maximum open position. As can be seen, this system has many limitations, including the requirement of a piezo actuator, which may require substantial space within the injector, placement of the control valve close to the needle valve, and only feedback when the control valve actually contacts the needle valve at the maximum open position.

The present invention is directed at overcoming one or more of the above problems.

SUMMARY OF THE INVENTION

In one embodiment of the present invention, a fuel injector comprises a lower body, a tip having an outer surface and a inner surface forming a bore, an orifice disposed within the tip and being opened at the inner and outer surfaces and a fuel passage disposed in the tip and in fluid communication with the orifice. The fuel injector also comprises a needle valve disposed within the bore and being movable between first position at which fluid communication between the orifice and fuel passage is blocked and a second position at which fluid communication between the orifice and fuel passages is open. The fuel injector also includes a fuel chamber disposed in the tip and a pressure control cavity disposed in the lower body and being adapted to receive a pressurized fluid. The needle valve has a first surface open to pressure control cavity and the needle valve is fluidly biased toward the first position by pressurized fluid acting on the first surface. The needle valve also has a second surface and is fluidly biased toward a second position by pressurized fluid acting on a second surface. Additionally, the fuel injector includes a sensor disposed in the lower body and being adapted to measure a pressure within the pressure control cavity.

In another embodiment of the present invention, a method of timing a needle valve in a fuel injector composites steps of sensing a pressure in a pressure control cavity, delivering feedback signal in response to a sensing step and adjusting the needle valve timing in response to the feedback signal.

DETAILED DESCRIPTION

Figure 1:
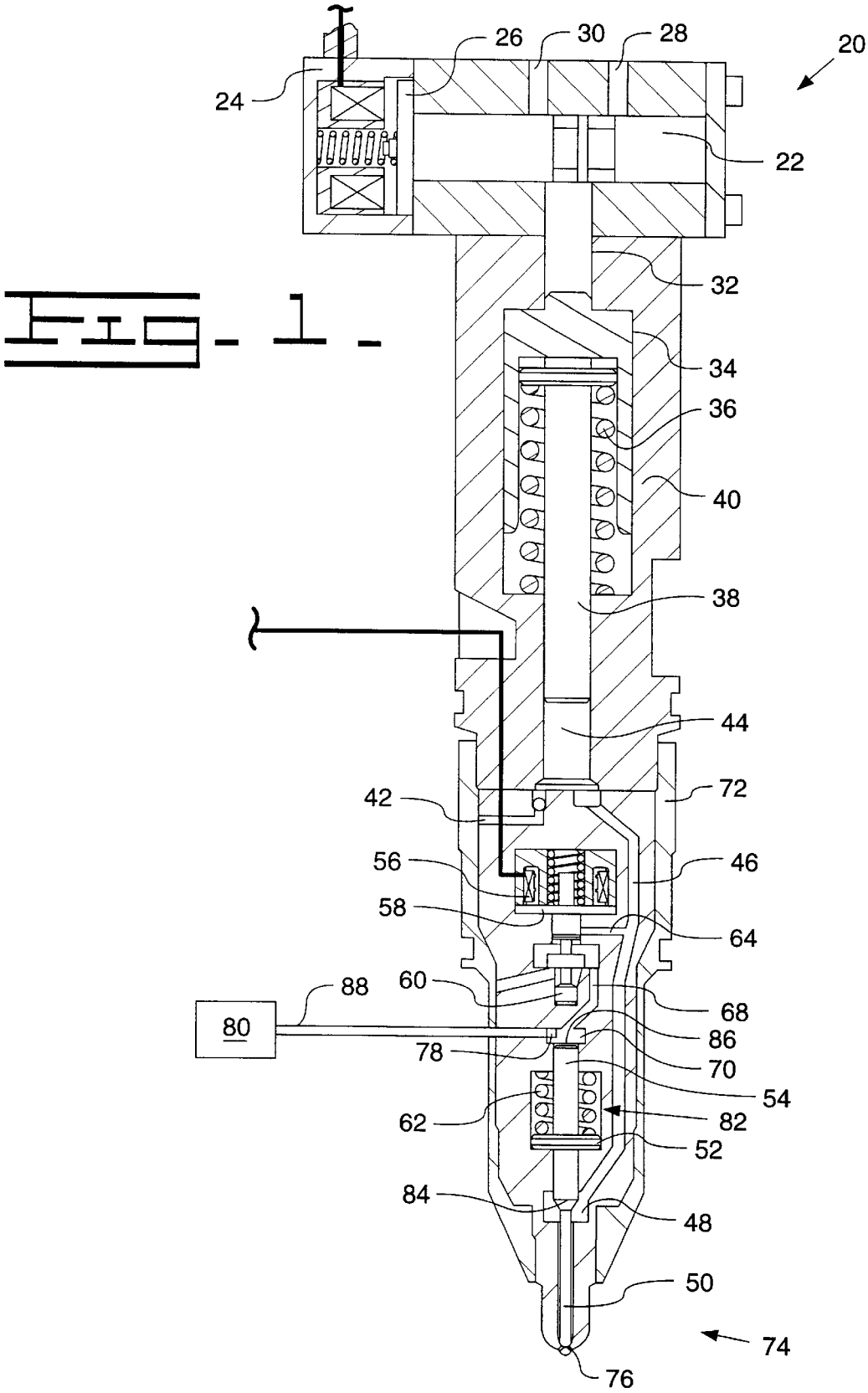
FIG. 1 is a diagrammatic cross section of fuel injector according to one embodiment of the present invention.

FIG. 1 illustrates a diagrammatic cross section of a fuel injector 20. In particular, fuel injector 20 is a hydraulically actuated electronically controlled fuel injector. A first section of fuel injector 20 includes a control valve 22 which is actuated by solenoid 24. When solenoid 24 is energized, an armature 26, attached to control valve 22 is pulled causing control valve 22 to either open actuation fluid inlet 28 or actuation fluid drain 30.

Within the upper body 40 of injector 20, a piston 34, piston return spring 36, and plunger 38 are used to pressurized fuel present in pressurization chamber 44. Specifically, fuel enters fuel injector 20 through fuel inlet 42. As low pressure fuel enters the fuel injector, it passes check valve 90 and fills fuel pressurization chamber 44. In order to pressurize the fuel, control valve 22 must be positioned in a first position such that high pressure actuation fluid from actuation fluid inlet 28 can communicate with actuation fluid passage 32 and thereby actuate piston 34. When high pressure fluid is present in actuation fluid passage 32, it acts upon the top of piston 34 causing it to compress piston return spring 36 and move plunger 38 downward, thereby pressurizing the fuel within fuel pressurization chamber 44 for injection. Once injection has occurred, control valve 22 is moved to a second position in which actuation fluid inlet 28 is blocked and actuation fluid passage 32 is open to communication with actuation fluid drain 30. When this occurs, the pressure in actuation fluid passage 32 is vented and piston return spring 36 causes plunger 38 and piston 34 to return to their original positions.

Within the lower body 72 of fuel injector 20, a direct operated needle valve 82 controls the injection of high pressure fuel from tip 74 into the combustion chamber (not shown). Specifically, high pressure fuel from fuel pressurization chamber 44 enters high pressure fuel line 46. Fuel from high pressure fuel line 46 fills fuel cavity 48 and communicates with direct operated check valve 60 via high pressure fuel passage 64. The needle valve 82 is composed of a check 50, a check spacer 52 and a check piston 54 and is biased in the downward or closed position by a check spring 62. In the closed position, fuel from fuel cavity 48 can not communicate with orifice 76, located in tip 74. Needle valve 82 is opened by high pressure fuel in fuel cavity 48 acting upon an opening surface 84 of check 50. When the force of high pressure fuel on opening surface 84 is greater than the force exerted by check spring 62, and the force exerted by fuel in cavity 70 as a result of piston 38 pressurizing the fuel, the needle valve moves in the upward or open position, allowing fuel communication between fuel cavity 48 and orifice 76.

In order to obtain more control over needle valve 82, high pressure fuel can be placed on top of check piston 54 to better control the timing of needle valve 82. Specifically, a direct operated check (DOC) valve 60 controls the flow of high pressure fuel from high pressure fuel passage 64 to pressure control cavity 70 through DOC fluid passage 68. The DOC valve 60 is attached to a DOC armature 58. A DOC solenoid 56 can be energized to move the DOC valve 60 between its open and closed positions. In its first position, DOC valve 60 allows fluid communication between high pressure fuel passage 64 and pressure control cavity 70. When high pressure fuel is present in pressure control cavity 70, the high pressure fuel acts upon a closing surface 86 of check piston 54, thereby countering the force of high pressure fuel acting on opening surface 84. In this state, needle valve 82 is pressure balanced and is kept in a closed position by check spring 62. When it is desirable to inject, the DOC solenoid 56 is energized, thereby pulling in DOC armature 58 and moving DOC valve 60 to a second position in which high pressure fluid passage 64 is blocked and opening fluid communication between pressure control cavity 70 and the DOC drain 60 via DOC fluid passage 68. When pressure control cavity 70 is open to DOC drain 66, thereby venting all high pressure acting upon closing surface 86, the needle valve 82 is opened as a result of the high pressure fuel acting upon opening surface 84, and overcoming the biasing force of the check spring 62. When needle valve 82 moves to the open position, injection occurs through orifice 76. When it is desirable to stop injection, DOC solenoid 56 is de-energized thereby blocking DOC drain 66 and once again allowing fluid communication between high pressure fuel passage 64 and pressure control cavity 70.

A pressure sensor 78 is located within the lower body of injector 20 and is adapted to sense the pressure within the pressure control cavity 70. The pressure sensor 78 can be placed in a variety of locations, but ideally sensor 78 would be located in pressure control cavity 70 or between pressure control cavity 70 and DOC valve 60, for instance within DOC fluid passage 68. Pressure sensor 78 is connected to an electronic control module (ECM) 80 via a wire 88.

ECM 80 also controls the timing of actuation for the DOC solenoid 56 and solenoid 24. Both solenoids are connected to ECM 80 via wires (not shown). When it is desired to actuate piston 34 or DOC valve 60, ECM 80 sends an appropriate signal to actuate either solenoid 24 or DOC solenoid 56.

Industrial Applicability

Control of fuel injection is vital to reducing emissions in today's engines. Engine manufactures are constantly devising new injection strategy's that require multiple injections and exact timing of those injection. Further, the injection profile, such as a ramp, square, or boot, also contributes significantly to emissions control. One way of obtaining better control of injections and injection rate shapes is the direct control of the needle valve 82. Specifically, controlling when the needle valve 82 opens independent of pressurizing the fuel allows for greater flexibility in both injection timing and rate shape. However, even when direct control of the needle valve 82 is achieved, it is possible to further enhance an injector's performance by knowing when the needle valve 82 is, in fact, open. By utilizing pressure sensor 78 within fuel injector 20, to measure the pressure within pressure control cavity 70, fuel injector 20 can be trimmed to further enhance performance. Trimming adjusts the timing of the valve movement to more accurately approximate the desired timing.

Specifically, pressure sensor 78 can measure the pressure within pressure control cavity 70 and send a feedback signal via wire 88 to ECM 80. ECM 80 can then determine whether or not needle valve 82 is in an open or closed position based upon the pressure within control cavity 70. Pressure sensor 78 can send either a digital or analog signal to ECM 80. Further, any type of pressure sensor would suffice but pressure sensor 78 is preferably of the piezo variety.

Figures 2A, 2B, 2C, 2D:
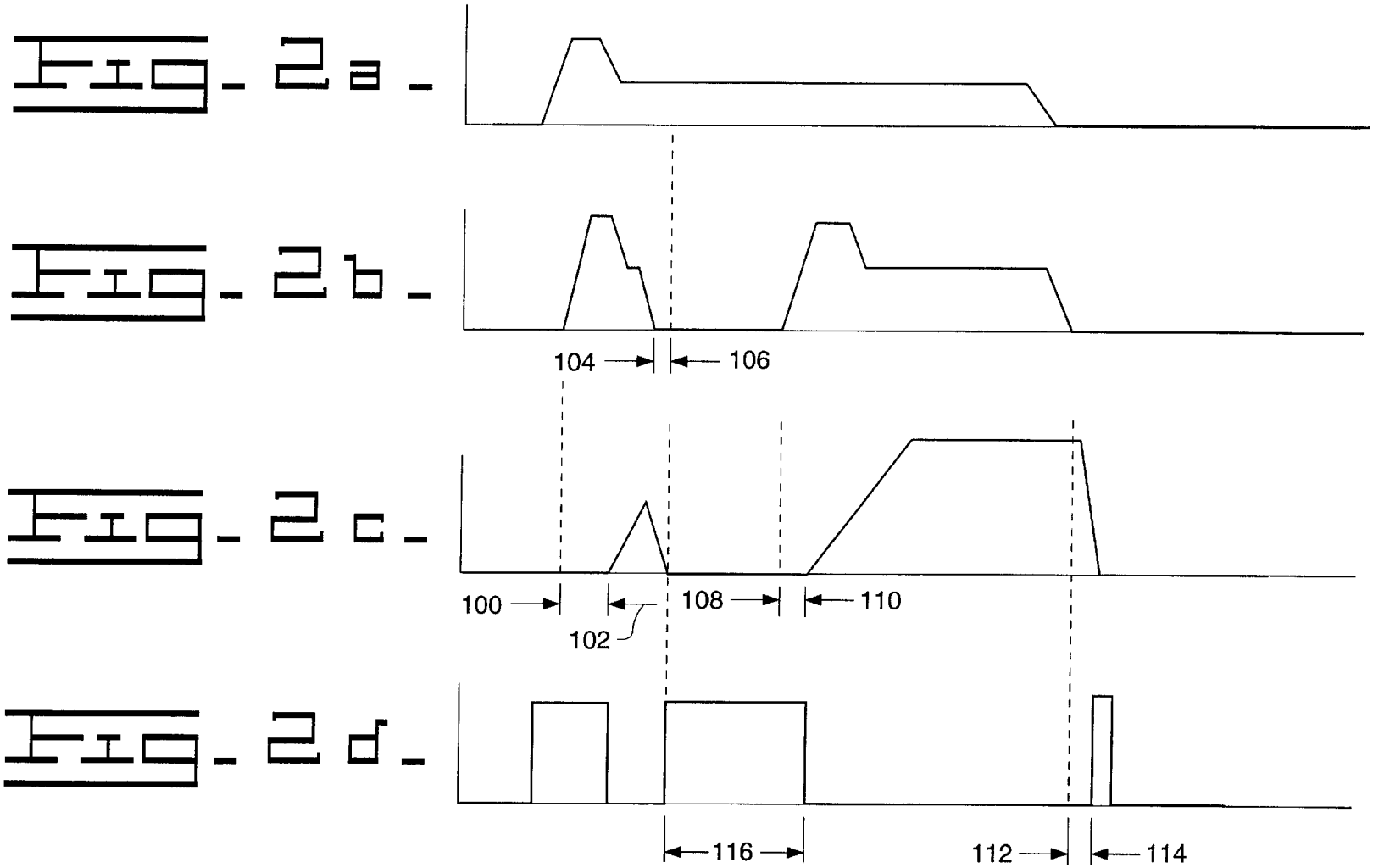
FIG. 2 is a graph illustrating current, rate, and pressure signal relationship in according to one embodiment of the present invention.

ECM 80 examines the feedback signal from pressure sensor 78 to determine if needle valve 82 is open or closed. The ECM 80 also examines the time associated with the pressure sensor 78 feedback signal to determine if the needle valve 82 is opening or closing as expected. FIG. 2 illustrates one example of the relationship between the ECM's 80 timing for the solenoid 24, DOC Solenoid 56, injection rate and pressure sense by pressure sensor 78. In this example, the pressure signal is a digital signal and is merely determining a pressure no pressure condition which may reduce the processing power needed by ECM 80. Specifically, FIG. 2*a* illustrates the oil current, which represents the ECM's 80 actuation signal sent to solenoid 24 to pressurize fuel. FIG. 2*b* is the DOC current which represents the actuation signal sent by the ECM 80 to DOC solenoid 56 in order to control the opening and the closing of needle valve 82. FIG. 2*c* illustrates the injection rate of the injector 20. FIG. 2*d* is the logic signal sent by pressure sensor 78 to ECM 80 representing the pressure/no pressure condition within control cavity 70. With respect to FIG. 2, the start of current 1 is represented by 100, and the start of injection 1 is represented by 102. End of current 1 is represented by 104 and end of injection 1 is represented by 106. Start of current 2 is indicated by 108 and start of injection 2 is indicated by 110. Finally, end of current 2 is represented by 112, and end of injection 2 is represented by 114. Additionally, the dwell time of the injector, the time between injections, is represented by 116.

If the timing of needle valve 82 is not as expected, as represented by the pressure signal from pressure sensor 78, the ECM 80 can alter the timing of the actuation control signal sent to the actuators in fuel injector 20 to improve injector performance. For example, if DOC valve 60 is opening slower than expected, meaning that pressure sensor 78 does not detect a drop in pressure within control cavity 70 when the ECM 80 expects, the ECM 80 can advance the timing of the actuation signal sent to DOC solenoid 56 in order to decrease the pressure within control cavity 70 sooner, resulting in quicker injection.

Although the description references a hydraulically actuated electronically controlled fuel injector, the present invention could be implemented in any other system in which pressure is used to control a valve, including common rail injectors and mechanical unit injectors. Further, the above description references a needle valve but this is also commonly known as a check valve. Those skilled in the art will appreciate other aspects, objects and advantages of this invention can be obtained from a study of the drawings, disclosure and claims.

What is claimed is:

1. A fuel injector comprising:

a lower outer body;

a tip having an outer surface and an inner surface forming a bore;

an at least one orifice disposed within said tip and being open at said inner and outer surfaces;

a fuel passage disposed in said tip and in fluid communication with said at least one orifice;

a needle valve with a first surface, a second surface and being disposed within said bore, said needle valve being moveable between a first position at which fluid communication between said orifice and said fuel passage is blocked and a second position at which fluid communication between said orifice and said fuel passage is open;

a fuel chamber disposed in said tip;

a pressure control cavity disposed in said lower body adapted to receive a pressurized fluid;

said needle valve having said first surface open to said pressure control cavity, said needle valve being fluidly biased towards said first position by pressurized fluid acting on said first surface and being fluidly biased towards said second position by pressurized fluid acting on said second surface; and a sensor disposed in said lower body and being adapted to measure a pressure within said pressure control cavity.

2. The fuel injector of claim 1, wherein said sensor being a piezo sensor.

3. The fuel injector of claim 1, wherein said sensor is adapted to deliver a digital signal.

4. The fuel injector of claim 1 further including a spring biasing said needle valve towards said first position.

5. The fuel injector of claim 1 further including a valve, disposed in said lower body, to control a flow of said pressurized fluid to said pressure control cavity.

6. The fuel injector of claim 5, wherein said valve being a three way valve.

7. The fuel injector of claim 5 further including a fuel passage between said valve and said pressure control cavity.

8. The fuel injector of claim 7, wherein said valve being disposed in said fuel passage.

9. The fuel injector of claim 7, wherein said sensor being adapted to measure the pressure within said fuel passage.

10. The fuel injector of claim 1, wherein said sensor being disposed in said pressure control cavity.

11. The fuel injector of claim 1, said needle valve being a check valve.

12. The fuel injector of claim 1, said needle valve including a check connected to a check spacer, and said space being connected to a check piston.

13. A method of trimming a timing a of a needle valve in a fuel injector, said fuel injector comprising said needle valve having a first surface and a pressure control cavity being adapted to receive a pressurized fluid, said first surface of being exposed to said pressurized fluid in said pressure control cavity and being adapted at least partially control a position of said needle valve, the method comprising the steps of:

sensing a pressure in said pressure control cavity;

delivering a feedback signal in response to said sensing step; and adjusting said needle valve timing in response to said feedback signal.

14. The method of claim 13 further comprising the step of determining if said pressure exceeds a predetermined pressure.

15. The method of claim 13 wherein said delivering step further includes the step of delivering said feedback signal to an electronic control module.

16. The method of claim 13 further comprising the step of determining if said needle valve is in an open position.

17. The method of claim 13 further comprising the step of determining if said needle valve is in a closed position.

18. The method of claim 13 wherein said delivering step further comprises the step of delivering a digital feedback signal.

* * * * *